US011857026B2

(12) United States Patent
Ikura

(10) Patent No.: US 11,857,026 B2
(45) Date of Patent: Jan. 2, 2024

(54) FOOTWEAR

(71) Applicant: Kiyoshi Ikura, Himeji (JP)

(72) Inventor: Kiyoshi Ikura, Himeji (JP)

( * ) Notice: Subject to any disclaimer, the term of this patent is extended or adjusted under 35 U.S.C. 154(b) by 0 days.

(21) Appl. No.: 18/024,187

(22) PCT Filed: Aug. 26, 2021

(86) PCT No.: PCT/JP2021/031349
§ 371 (c)(1),
(2) Date: Mar. 1, 2023

(87) PCT Pub. No.: WO2022/050168
PCT Pub. Date: Mar. 10, 2022

(65) Prior Publication Data

US 2023/0284740 A1 Sep. 14, 2023

(30) Foreign Application Priority Data

Sep. 1, 2020 (JP) ..... 2020-146909

(51) Int. Cl.
*A43B 13/14* (2006.01)

(52) U.S. Cl.
CPC ..... *A43B 13/14* (2013.01)

(58) Field of Classification Search
None
See application file for complete search history.

(56) References Cited

U.S. PATENT DOCUMENTS 4,241,523 A * 12/1980 Daswick ..... A43B 13/181 36/32 R
4,348,821 A * 9/1982 Daswick ..... A43B 13/145 36/114

(Continued)

FOREIGN PATENT DOCUMENTS

JP 57-55307 U 3/1982
JP 2009-118936 A 6/2009

(Continued)

OTHER PUBLICATIONS

International Preliminary Report on Patentability for PCT/JP2021/031349 (PCT/IPEA/409) dated Nov. 10, 2022.

(Continued)

*Primary Examiner* — Jila M Mohandesi
(74) *Attorney, Agent, or Firm* — Birch, Stewart, Kolasch & Birch, LLP

(57) ABSTRACT

[Problem] An object of the present invention is to provide a footwear that reduces deceleration in a traveling direction at landing on the ground and that facilitates acceleration at treading on the ground.

[Solution] The present invention provides a footwear comprising a sole having an upper surface on a side that comes in contact with a bottom of a foot and a bottom surface on a side that touches a ground, wherein in a longitudinal cross-sectional view of the sole, an angle β is an angle between a straight line L1 and a plane that the bottom surface of the sole is in contact with, and ranges from 10 degrees to 75 degrees, an angle α is an angle between a straight line L3 and the plane that the bottom surface of the sole is in contact with, and ranges from 5 degrees to 65 degrees, a contact point A is positioned closest to a toe side of points where the bottom surface of the sole is in contact with the plane, a point B is a point of the sole closest to the toe side, the straight line L1 passes through the contact point A and the point B, the line L2 passes through the contact point A and is perpendicular to the plane that the bottom surface of the sole is in contact with, and intersects with the upper surface of the sole at an intersection point C and the straight L3 passes through the intersection point C and the point B.

20 Claims, 10 Drawing Sheets

(56) References Cited

U.S. PATENT DOCUMENTS

| | | | | |
|---|---|---|---|---|
| 5,579,591 | A * | 12/1996 | Kousaka | A43B 13/143 36/31 |
| 5,592,757 | A * | 1/1997 | Jackinsky | A43B 13/12 36/31 |
| 7,287,340 | B2 * | 10/2007 | Talbott | A43B 17/00 36/114 |
| 10,779,611 | B2 * | 9/2020 | Jackinsky | A43B 17/14 |
| 2004/0205983 | A1 * | 10/2004 | Talbott | A43B 13/14 36/102 |
| 2007/0051020 | A1 * | 3/2007 | Tajima | A43B 3/0042 36/132 |
| 2007/0283599 | A1 * | 12/2007 | Talbott | A43B 13/145 36/31 |
| 2009/0133290 | A1 | 5/2009 | Kawai | |
| 2011/0225852 | A1 * | 9/2011 | Mahoney | A43B 13/12 36/30 R |
| 2017/0035143 | A1 | 2/2017 | Sato et al. | |
| 2017/0095034 | A1 | 4/2017 | Dupre et al. | |
| 2017/0150782 | A1 * | 6/2017 | Moriyasu | A43B 13/26 |
| 2019/0045885 | A1 * | 2/2019 | Hatfield | A43B 13/14 |
| 2021/0267306 | A1 | 9/2021 | Sakaguchi et al. | |

FOREIGN PATENT DOCUMENTS

| | | | |
|---|---|---|---|
| JP | 2011-212410 | A | 10/2011 |
| JP | 6310427 | B2 | 4/2018 |
| JP | 2018-534028 | A | 11/2018 |
| WO | WO 2013/034870 | A1 | 3/2013 |
| WO | WO 2020/136916 | A1 | 7/2020 |

OTHER PUBLICATIONS

International Search Report for PCT/JP2021/031349 (PCT/ISA/210) dated Nov. 2, 2021.

Written Opinion of the International Searching Authority for PCT/JP2021/031349 (PCT/ISA/237) dated Nov. 2, 2021.

* cited by examiner

FOOTWEAR

TECHNICAL FIELD

The present invention relates to a footwear.

BACKGROUND TECHNOLOGY

Improving the sole structure of a footwear has been studied to improve the performance of the footwear.

For example, Patent Document 1 discloses a sole structure of a sports shoe, which is provided at least in the heel portion of the sole structure, has a wavy shape in the peripheral portion of the heel, and has an amplitude of the wavy shape. A plurality of elastic members made of a wave plate that increases toward the heel peripheral side, and that is arranged along the heel peripheral portion on the lower surface of the wave plate and whose upper surface is fixed to the lower surface of the wave plate and the upper surface of the pillar member has an inclined surface in which the height from the lower surface decreases toward the peripheral edge of the heel is disclosed.

For example, Patent Document 2 discloses a shoe sole structure comprising an upper plate arranged at least in a forefoot region of the shoe, a lower plate arranged below the upper plate with a space therebetween, a midsole sandwiched between the upper plate and the lower plate, extending across the entire width of the forefoot region of the shoe and being softer than the upper and lower plates, wherein the midsole is central in the width direction. Disclosed is a sole structure of a shoe characterized by having a concave portion curved upward at a portion thereof and extending in the front-rear direction.

PRIOR ARTS

Patent Document 1: Japanese Patent Publication No. 2009-118936A

Patent Document 2: Japanese Patent No. 6310427B

SUMMARY OF THE INVENTION

Problems to be Solved by the Invention

An object of the present invention is to provide a footwear that reduces deceleration in a traveling direction at landing on the ground and that facilitates acceleration at treading on the ground.

Means to Solve Problems

The present invention provides a footwear comprising a sole having an upper surface on a side that comes in contact with a bottom of a foot and a bottom surface on a side that touches a ground, wherein in a longitudinal cross-sectional view of the sole, an angle β is an angle between a straight line L1 and a plane that the bottom surface of the sole is in contact with, and ranges from 10 degrees to 75 degrees, an angle α is an angle between a straight line L3 and the plane that the bottom surface of the sole is in contact with, and ranges from 5 degrees to 65 degrees, a contact point A is positioned closest to a toe side of points where the bottom surface of the sole is in contact with the plane, a point B is a point of the sole closest to the toe side, the straight line L1 passes through the contact point A and the point B, the line L2 passes through the contact point A and is perpendicular to the plane that the bottom surface of the sole is in contact with, and intersects with the upper surface of the sole at an intersection point C, and the straight L3 passes through the intersection point C and the point B.

Effect of the Invention

The present invention provides a footwear that reduces deceleration in a traveling direction at landing on the ground and that facilitates acceleration at treading on the ground.

MODE FOR CARRYING OUT THE INVENTION

Figure 1:
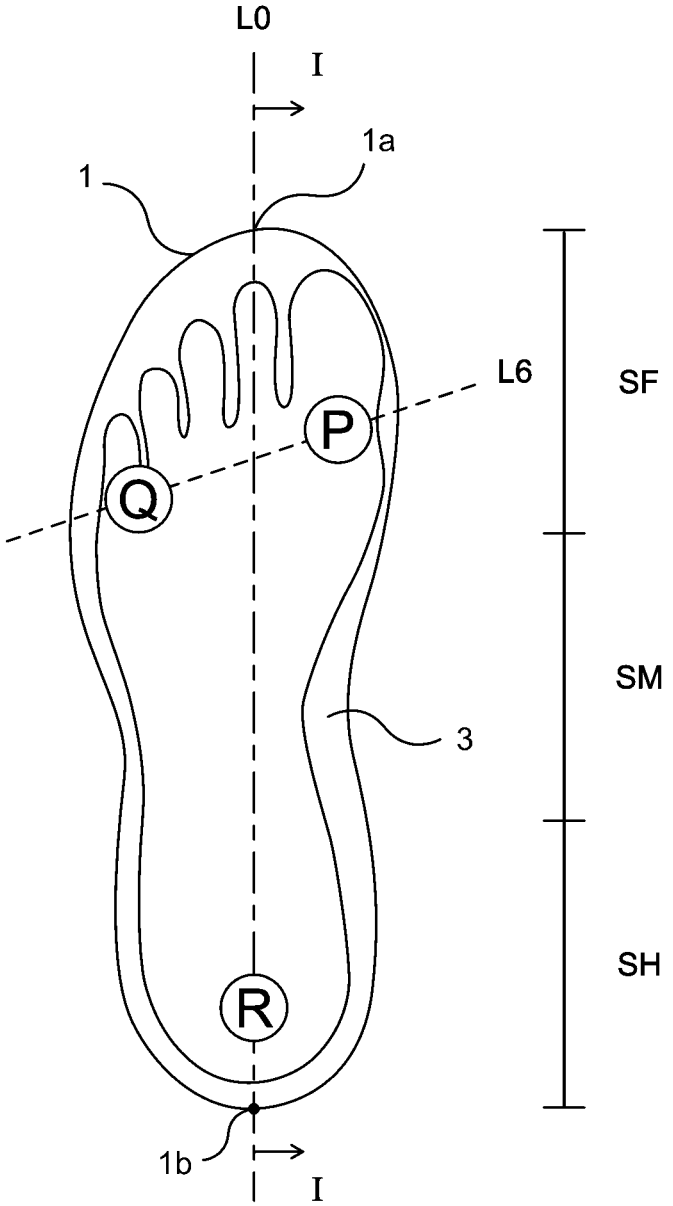
FIG. 1 is an explanatory view for illustrating one embodiment of a sole of the footwear of the present invention.

The present invention provides a footwear comprising a sole having an upper surface on a side that comes in contact with a bottom of a foot and a bottom surface on a side that touches a ground, wherein in a longitudinal cross-sectional view of the sole, an angle β is an angle between a straight line L1 and a plane that the bottom surface of the sole is in contact with, and ranges from 10 degrees to 75 degrees, an angle α is an angle between a straight line L3 and the plane that the bottom surface of the sole is in contact with, and ranges from 5 degrees to 65 degrees, a contact point A is positioned closest to a toe side of points where the bottom surface of the sole is in contact with the plane, a point B is a point of the sole closest to the toe side, the straight line L1 passes through the contact point A and the point B, the line L2 passes through the contact point A and is perpendicular to the plane that the bottom surface of the sole is in contact with, and intersects with the upper surface of the sole at an intersection point C, and the straight L3 passes through the intersection point C and the point B.

The embodiments of the present invention are described below with reference to the drawings, but the present invention is not limited to the embodiments shown in the drawings. In the present invention, the toe side of the footwear is defined as the front side and the heel side is defined as the rear side. The direction connecting the toe and the heel defines as the front-rear direction of the footwear. The horizontal direction orthogonal to the front-rear direction is defined as the width direction of the footwear. The thumb side of the footwear is defined as the inner side and the little toe side is defined as the outer side.

FIG. 1 shows a plan view of an embodiment of a sole of the footwear of the present invention. The sole 1 has a forefoot portion SF, a middle foot portion SM and a rear foot portion SH. The forefoot portion SF, midfoot portion SM, and rearfoot portion SH of the sole 1 are the portions of the footwear that are in contact with the forefoot, midfoot, and rearfoot, respectively, of the person wearing the footwear (hereinafter referred to as the "wearer").

In FIG. 1, the sole 1 of the footwear of the present invention is preferably configured to warp the tip of the forefoot portion SF upward, bordering the line L6 which connects the ball of the thumb P and the ball of the little toe Q of the foot of the wearer. In this case, an inside (side of the ball of the thumb) of the footwear begins to warp in the portion near to the tip than the outside (side of the ball of the little toe) of the footwear. The line L6 connecting the ball of the thumb P and the ball of the little toe Q may be a straight line or a curve with the center of curvature on the apical side. The angle of warp may be made loose near the first joint in order to grip the sole with the toes. The warp may be made to warp upward from a position more posterior to L6.

It is preferable, when viewing the footwear from the front, that the tip is raised and furthermore, the tip is positioned more on the ball of the thumb than on the ball of the little toe.

In FIG. 1, the straight line LO is a straight line extending in the front-rear direction of the sole 1 and passing through a position corresponding to approximately the center of the second toe when the foot is placed on the sole 1. In FIG. 1, straight line LO passes through the approximately leading tip 1*a* and the approximately trailing tip 1*b* of the footwear.

Figure 2:
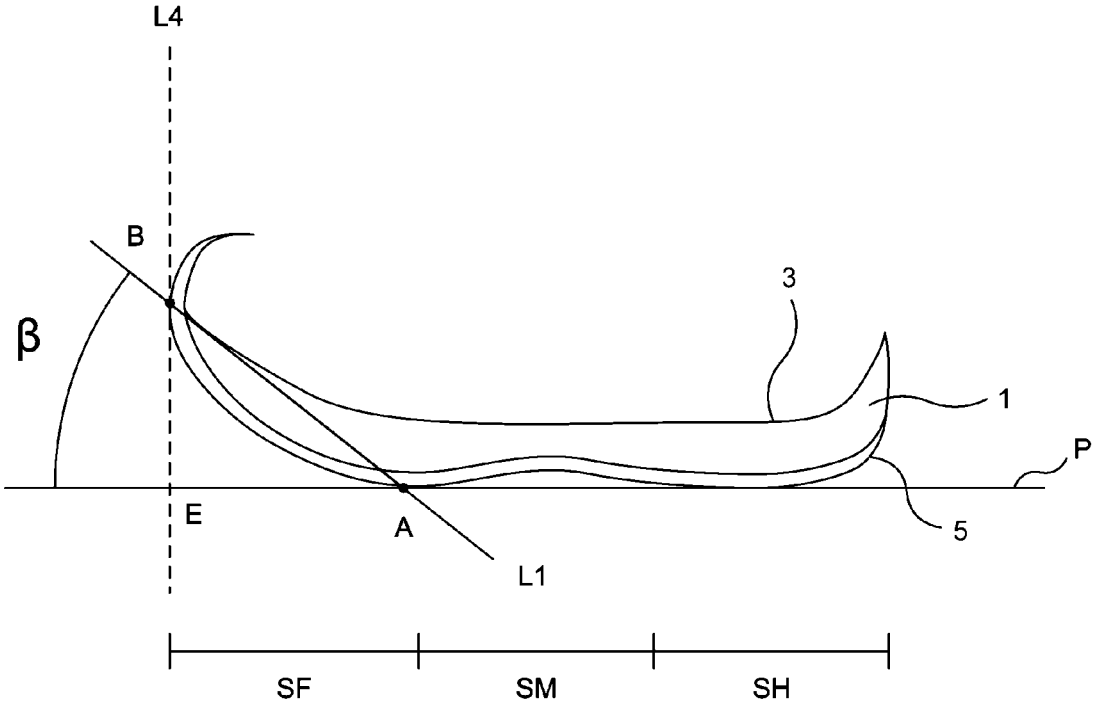
FIG. 2 is an explanatory view for illustrating one embodiment of a sole of the footwear of the present invention.
Figure 3:
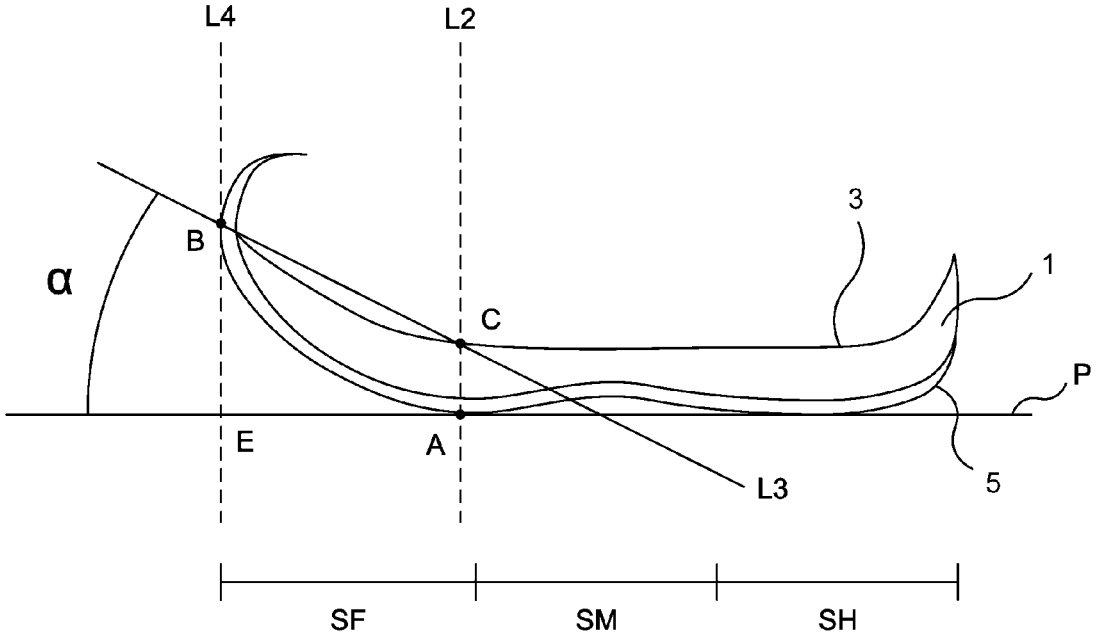
FIG. 3 is an explanatory view for illustrating one embodiment of a sole of the footwear of the present invention.

FIGS. 2 and 3 show a longitudinal sectional view of the sole of the footwear taken along line I-I (straight line L0) of the sole of the footwear in FIG. 1. FIG. 2 is an explanatory view illustrating the angle β in the sole of the present invention. FIG. 3 is an explanatory view illustrating the angle α in the sole 1 of the present invention. The aforementioned angles α and β in the sole of the present invention indicate the angles viewed from the outside (the side of the ball of the little toe) in the longitudinal cross-sectional view of the I-I-line L0 in FIG. 1.

In FIGS. 2 and 3, the sole 1 has an upper surface 3 on the side which comes is in contact with the bottom of the foot, and a bottom surface 5 on the side that touches the ground (plane P). The sole bottom surface 5 has at least one contact surface with the ground (plane P) at least two points in total in each of the region from the forefoot portion to midfoot portion and the rearfoot portion. Since the center of gravity of the footwear is on the forefoot side, the sole bottom surface 5 may not touch the ground (plane P) in the rearfoot portion. In such a case, it is preferable to lightly press the rear foot portion to make the sole bottom surface 5 being in contact with the ground (plane P) in the rearfoot portion. A contact point A is a contact point positioned closest to the toe side of the points where the sole bottom surface 5 is in contact with a plane P.

A contact point A positioned closest to the toe side of the points where the sole bottom surface 5 is in contact with the plane P, is preferably positioned from the sole tip 1*a* to 15% to 60% of the length of the entire sole. The contact point A is preferably positioned from the sole tip 1*a* to 15% to 55% of the length of the entire sole, more preferably 15% to 40% of the length of the entire sole, and even more preferably 17% to 38% of the length of the entire sole, and further more preferably positioned to 20% to 35% of the length of the entire sole. It is noted that the sole tip 1*a* is defined as 0% and the sole trailing edge 1*b* is defined as 100%.

Further, a point B is a point located on the most toe side of the sole. That is, the point B is the point where the perpendicular line L4 to the plane P which the sole bottom surface 5 is in contact with is tangent to the toe tip of the sole. The point B is preferably on the front surface or bottom surface of the sole. If the tip of the bottom surface of the sole is warped, the point B exists, for example, on the bottom surface of the sole. If the tip of the bottom surface of the sole is not so warped, the point B exists, for example, on the front surface of the sole. In the present invention, the angle β formed between the straight line L1 connecting the contact point A and the point B and the plane P which the bottom surface of the sole is in contact with ranges from 10 degrees to 75 degrees.

The angle β is preferably 10 degrees or more, more preferably 15 degrees or more, even more preferably 20 degrees or more, further preferably 25 degrees or more, further more preferably 30 degrees or more, further more preferably 35 degrees or more, most preferably 40 degrees or more. The angle β is preferably 75 degrees or less, more preferably 70 degrees or less, even more preferably 65 degrees or less, and most preferably 60 degrees or less.

If the angle β is within the above range, it is considered that the following effects can be obtained.

Raising the tip of the footwear makes it less likely that the wearer will stumble over things or get caught on the ground, and thus will be less likely to fall down. Therefore, it is useful not only for elderly people who have difficulty lifting their legs, but also for children and workers.

Raising the tip of the footwear makes it easier for the wearer to land directly below or behind the body while running, thereby making it difficult to decelerate. Furthermore, by raising the tip of the footwear, it becomes easier to put the weight on the toe while running, so that it becomes possible to step and kick from the back side of the body, and it becomes easier to obtain propulsion.

As will be described later, the fact that the angle β is 10 degrees or more does not mean that the fingertip is raised. This is because if the sole of the footwear is thick, the fingertips does not necessarily rise even if β is angled. Although it is possible to further increase the angle of β, the fingertips are bent too much, which may hinder walking and running.

FIG. 3 shows a side view of one embodiment (same as FIG. 2) of the sole of the footwear of the present invention. In FIG. 3, a point C is the intersection of the line L2 and the sole upper surface 3, and the line L2 passes through the contact point A and is perpendicular to the plane P which the sole bottom surface 5 is in contact with. A point B is a point located closest to the toe side of the sole. That is, the point B is the point where the line L4 is tangent to the toe tip of the sole, and the line L4 is perpendicular to the plane P which the sole bottom surface 5 is in contact with. In the present invention, the angle α between the straight line L3 connecting the points C and B and the plane P which the sole bottom surface 5 is in contact with is 5 degrees to 65 degrees.

The angle α is preferably 5 degrees or more, more preferably 10 degrees or more, even more preferably 15 degrees or more, further preferably 20 degrees or more, and further more preferably 25 degrees, most preferably 30 degrees or more. The angle α is preferably 65 degrees or less, more preferably 60 degrees or less, and even more preferably 55 degrees or less. The angle α of 5 degrees or more means that the fingertip is raised. Although it is possible to further increase the angle α, the fingertips may be bent too much, which may hinder walking and running.

If the aforementioned angle α is within the range, it is considered that, for example, the following effects can be obtained.

By raising the fingertips, it is possible to approximate to walking or running barefoot. Normally, people land on their toes (specifically, the balls of their thumbs and the balls of their little toes) not on their heels when they are barefoot. However, with the spread of shoes, heel-landing has become common walking and running because the shoes absorb the impact even when landing on the heel. Occasionally, some people can land on their heels even when barefoot, which raises concerns about injury. It is possible for a person who is used to wearing normal shoes to land on the ball of the thumb or the ball of the little toe, but it would be difficult because the fingertips interfere.

When people land on the ground while running, they decelerate due to reaction force and frictional force from the ground. In order to reduce the reaction force from the ground, it is desirable to land directly below or behind the body rather than in front of the body. A forefoot or midfoot landing can be possible when trying to land straight down below the body, but a forefoot landing is preferable for landing behind the body. At that time, it would be difficult to land on the forefoot with normal shoes because the fingertips interfere. If people wear the footwear of the present invention, they can easily land on the forefoot by raising their fingertips. Furthermore, it is preferable to raise the fingertips more in order to land behind the body.

When people run, they obtain forward propulsion by stepping and kicking with their rear foot. Assuming that the force of stepping and kicking is constant, the propulsive force is greater when the stepping and kicking is done in the rearward direction. However, people's legs have the property that it is easy to bend forward, but difficult to bend backward. However, raising the heel makes it easier to bend backwards. So, raising your fingertips makes it easier to stand on your toes, making it possible to obtain greater propulsion.

Walking or running on a forefoot landing with raising the fingertips up can exercise the buttocks muscles immensely. As a result, a hip-enhancing effect can be expected, as a lift is created inside the buttocks and sagging of the buttocks is suppressed. Furthermore, it can be expected to improve standing posture and thus make the legs look longer.

In the present invention, the angles α and β are preferably set more specifically according to the thickness of the sole of the footwear and the usage of the wearer.

In a preferred aspect of the present invention, the angle α and the angle 62 satisfy the relationship of formula (1).

$$\alpha \leq \beta \quad (1)$$

When formula (1) is satisfied, the effect of reducing the impact on the foot during walking and running due to the sole can be obtained.

In another preferred aspect of the present invention, the angle α and the angle β satisfy the relationship of formula (2).

$$0 \leq (\beta - \alpha) \leq 30 \quad (2)$$

When the formula (2) is satisfied, the effect of softening the impact at the time of landing and increasing the propulsive force at the time of stepping or kicking can be obtained. The value of (β−α) is preferably 5 or more, more preferably 10 or more, even more preferably 15 or more, and further more preferably 20 or more.

In yet another preferred aspect of the present invention, the angle α and the angle 62 satisfy the relationship of formula (3).

$$1 \leq (\beta/\alpha) \leq 8 \quad (3)$$

When the formula (3) is satisfied, it is possible to soften the impact at the time of landing and to increase the propulsive force at the time of stepping or kicking. The value of (β/α) is preferably 2 or less, more preferably 1.5 or less, even more preferably 1.3 or less, and further more preferably 1.2 or less.

The footwear of the present invention preferably satisfies at least one of the formulas (1) to (3), and more preferably satisfies all the formulas (1) to (3).

The upward warp of the sole of the footwear may be a curve with an upward center of curvature, a straight line, or a combination of these, but a curve or straight line with a downward center of curvature or a combination of these is undesirable.

Figure 4:
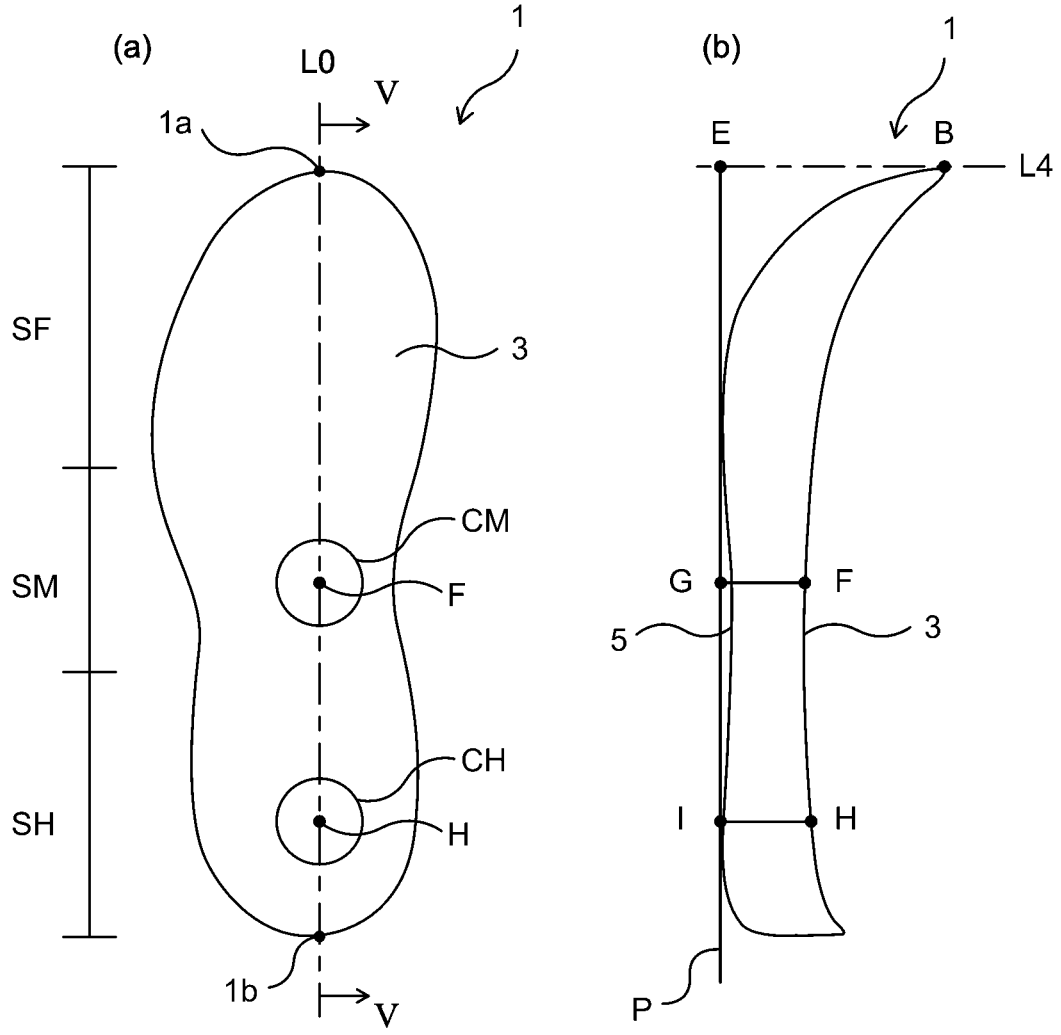
FIG. 4 is an explanatory view for illustrating one embodiment of a sole of the footwear of the present invention.

FIG. 4 shows an explanatory view for illustrating the height of the toe spring of the sole of the footwear of the present invention, the thickness of the sole, and the height of the upper surface of the sole in the midfoot portion and rearfoot portion. FIG. 4(*a*) shows a plan view of one embodiment of the sole of the footwear of the present invention. The sole 1 has a forefoot portion SF, a middle foot portion SM and a rearfoot portion SH. The forefoot portion SF, the middle foot portion SM, and the rearfoot portion SH of the sole 1 are the portions where the forefoot portion, midfoot portion, and rearfoot portion of the foot of the person who wears the footwear (hereinafter referred to as the "wearer") come into contact with each other. A straight line L0 is a straight line extending in the front-rear direction of the sole 1 and passes through a position corresponding to approximately the center of the second toe when the foot is placed on the sole 1. FIG. 4(*b*) is a sectional view taken along line V-V in FIG. 4(*a*).

The height of the toe spring of the sole (the height of warping the forefoot upward), is appropriately set according to the thickness of the insole in the middle of the sole and the length of the footwear, and is preferably 3 cm or more, more preferably 5 cm or more, even more preferably 7 cm or more, further preferably 8 cm or more, further more preferably 10 cm or more, and is preferably 14 cm or less, more preferably 13 cm or less, even more preferably 12 cm or less.

The height of the toe spring of the sole is the distance between the points BE in FIG. 4(*b*). A point B is a point located closest to the toe side of the sole. That is, the point B is the point where the perpendicular line L4 to the plane P which the sole bottom surface 5 is in contact with is tangent to the toe tip of the sole. The point E is the intersection where the perpendicular line L4 passing through the point B intersect with the plane P. The height of the sole toe spring is, for example, the distance between the point B and the intersection point E where the perpendicular line L4 passing through the point B intersect with the plane P which the sole bottom surface 5 is in contact with in FIGS. 1 and 2.

The thickness of the sole is preferably 0.5 cm or more, more preferably 1 cm or more, even more preferably 2 cm or more, still more preferably 3 cm or more, and is preferably 10 cm or less, more preferably 9 cm or less, and even more preferably 8 cm or less.

The thickness of the sole may be the same or different in the forefoot, midfoot and rearfoot portions. The thickness of the midfoot portion of the sole is preferably the same as or thinner than the thickness of the rearfoot portion of the sole. The difference between the rear foot portion of the sole and the middle foot portion of the sole (rear foot portion—middle foot portion) is preferably −0.5 cm or more, more preferably 0.5 cm or more, and even more preferably 1.0 cm or more. The thickness of the rear portion of the sole can be increased for shock absorption and efficient forward propulsion. Also, the thickness of the forefoot portion of the sole can be increased to provide shock absorption during forefoot landing.

With respect to the height of the upper surface of the sole of the footwear (the distance between the upper surface of the sole and the plane where the sole bottom surface is in contact with), the height Hm of the upper surface of the sole in the midfoot portion is almost the same as the height Hr of the upper surface of the sole in the rearfoot portion. The absolute value of the difference between the height Hm of the midfoot portion and the height Hr of the rearfoot portion (|Hm-H r|) is preferably 0 cm or more, more preferably 1.0 cm or less is preferred, and even more preferably 0.5 cm or less.

The height Hm of the upper surface of the sole in the midfoot portion is the shortest distance between the plane P that the sole bottom surface touches, and the center point F which is the center point of a circle CM drawn on the upper surface of the sole of the midfoot portion SM without touching the inside and outside edges of the sole. That is, the height Hm of the upper surface of the sole in the midfoot portion is the length of the line segment FG, and the point G is the intersection point where the perpendicular line to the plane P passing through the center point F intersect with the plane P. The radius of the circle CM is preferably 0.5 cm or more, more preferably 1 cm or more, and is preferably 9 cm or less, more preferably 8 cm.

The height Hr of the upper surface of the sole in the rearfoot portion is the shortest distance between the plane P, that the sole bottom surface is in contact with, and the center point H which is the center point of a circle CH drawn on the upper surface of the sole in the rearfoot portion SH without touching the inside and outside edges of the sole. That is, the height Hr of the upper surface of the sole in the rearfoot portion is the length of the line segment HI, and the point I is the intersection point where the perpendicular line to the plane P passing through the center point H intersect with the plane P. The radius of the circle CH is preferably 0.5 cm or more, more preferably 1 cm or more, and is preferably 10 cm or less, more preferably 9 cm.

The center point F of the circle CM of the midfoot portion and the center point H of the circle CH of the rearfoot portion are preferably on the line L0.

It is preferable that the sole bottom surface of the footwear of the present invention is curved upward on the tip side from the contact point A located closest to the toe side of the points where the sole bottom surface 5 is in contact with the plane P. It is preferable that the bottom surface of the sole of the forefoot portion is warped so that the height of the warp is gradually increased from the contact point A toward the tip of the sole. The upward curvature of the sole bottom surface may be a curve with a center of curvature upward, a straight line, or a combination thereof, but a curve or straight line with a center of curvature downward, or a combination thereof undesirable.

As for the sole bottom surface of the footwear of the present invention, it is preferable that only the forefoot portion warps up, and that the sole bottom surface of the rearfoot portion does not warp up. The bottom surface of the rearfoot portion of the sole preferably has a contact surface that is in contact with the ground when the wearer of the footwear wears the footwear (upright). It is preferable that the bottom surface of the midfoot portion of the sole has a non-grounding arch surface that is curved upward and does not touch the ground.

The sole of the footwear of the present invention preferably does not include a reverse heel type sole in which the height of the upper surface of the sole gradually decreases from the toe to the heel. In addition, the sole of the footwear of the present invention preferably does not include a sole that has a ground contact surface with the ground in the midfoot portion, such that the sole bottom surface warps up from this ground contact surface in the midfoot portion toward the rear end of the heel when the wearer of the footwear is wearing the footwear (upright).

The sole of the footwear of the present invention preferably has a structure of one or more layers. For example, the sole of the multi-layer structure comprises an embodiment comprising an insole having a sole upper surface and an outsole having a bottom surface that touches the ground, and an embodiment comprising an insole having a sole upper surface, an outsole having a bottom surface that touches the ground and a midsole positioned between the insole and the outsole.

Figure 5:
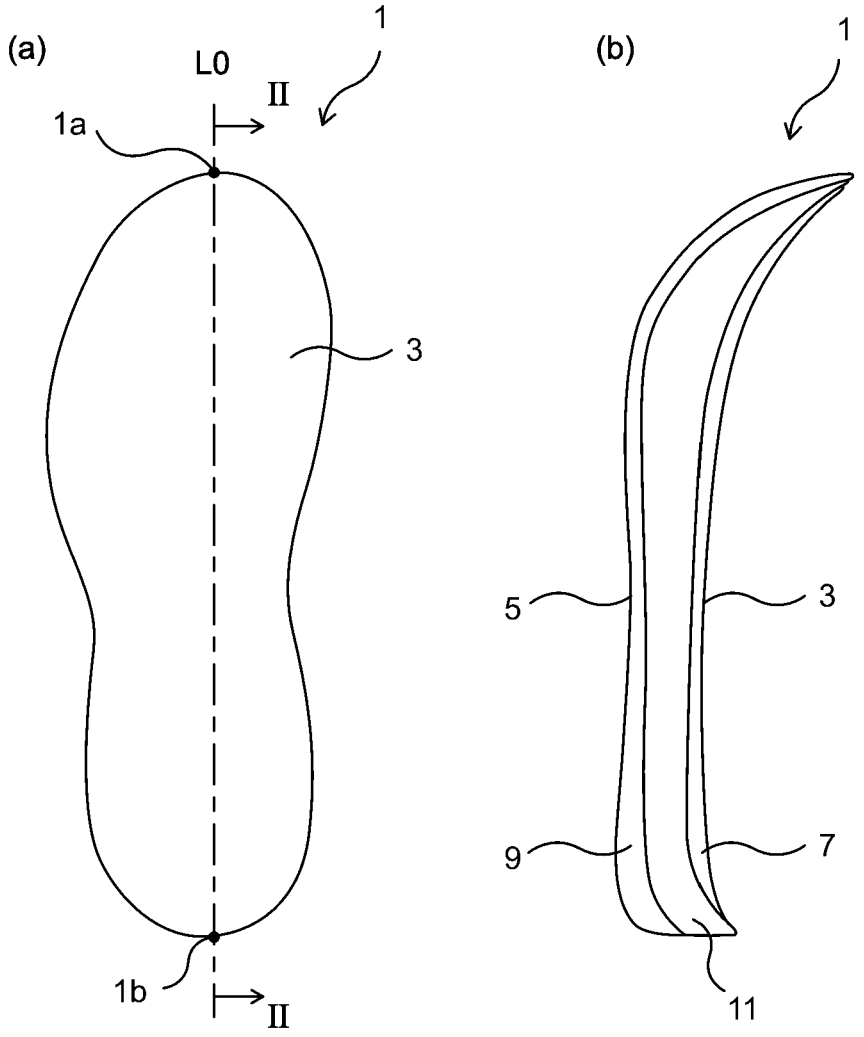
FIG. 5 is an explanatory view for illustrating one embodiment of a sole of the footwear of the present invention.

The sole shown in FIGS. 2 and 3 has an insole and an outsole, and the tip of the outsole is warping upward. FIG. 5 is an explanatory view for illustrating a sole in a preferred embodiment of the invention. FIG. 5(*a*) is a plan view, and FIG. 5(*b*) is a sectional view taken along the line II-II in FIG. 5(*a*).

In a preferred form of the invention, for example, as shown in FIG. 5(*b*), the sole 1 has an insole 7 having a sole upper surface 3, an out sole 9 having a bottom surface that touches the ground 5, and a midsole 11 located between the insole 7 and outsole 9. In this case, the sole bottom surface of the ball of the thumb, the ball of the little toe and the heel are preferably in contact with the ground.

The outsole 9, the midsole 11, and the insole 7 are all slanted upward so that the tip of the forefoot portion thereof warps upward. The outsole 9, midsole 11, and insole 7 are provided so that their tip edges are aligned. That is, the midsole 11 covers the insole 7 up to the tip edge, and the outsole 9 covers the midsole 11 up to the tip edge. A bottom surface 5 at the tip of the outsole 9 warps upward to form the front surface of the sole. The tip of the outer sole 9 may be configured to extend forward or upward from the tip edge of the midsole 11 or the tip edge of the insole 7.

The outsole 9 is required to have durability, abrasion resistance, etc., because the outsole 9 comes into contact with the ground, and is preferably arranged from the front end to the rear end of the footwear.

The bottom surface of the outsole 9 in contact with the ground is such that the grip between the ground and the outsole is retained, and may have a regular diamond, parallelogram, triangle, V-shape, or other block shape, a corrugated shape, a shape divided by slits, a shape combining these shapes, or even an irregular shape, without being limited to these patterns.

The outsole 9 may consist of one part or a plurality of parts, and is produced by a known method.

Examples of materials for the outsole 9 include any materials, for example, a thermoplastic synthetic resin such as ethylene-vinyl acetate copolymer (EVA), a thermosetting resin such as polyurethane (PU), rubber materials such as butadiene rubber and chloroprene rubber, and the like.

The midsole 11 is positioned between the insole 7 and the outsole 9 (upper side of the outsole 9), and is joined to the outsole 9 by a known technique such as an adhesive.

The midsole 11 is made of a soft elastic material such as a thermoplastic synthetic resin such as ethylene-vinyl acetate copolymer (EVA) or polypropylene, a foam of the thermoplastic synthetic resin; a thermosetting resin such as polyurethane (PU), a foam of the thermosetting resin; rubber materials such as butadiene rubber and chloroprene rubber, foams of rubber materials.

The midsole 11 may have a constant thickness from the tip to the rear end, or may vary in thickness. For example, the midsole may have a constant thickness from the rearfoot portion to the midfoot portion, and may become thinner or thicker toward the tip. Considering the impact absorption at the time of landing, it is desirable to thicken the entire midsole (from the tip to the rear end).

The midsole 11 may be composed of one part or may be composed of a plurality of parts. Further, the midsole 11 may be perforated and another material may be placed in the midsole 11.

The insole 7 is arranged on the midsole 11. It is preferable that the insole 7 has a raised arch portion in order to enhance comfort. The insole 7 may be removable, or may be fixed to the midsole 11 with an adhesive or the like.

The insole 7 is made of any material, including, for example, a thermoplastic synthetic resin such as ethylene-vinyl acetate copolymer (EVA) or polypropylene or a foam of the thermoplastic synthetic resin, a thermosetting resin such as polyurethane (PU) or a foam of the thermosetting resin, a rubber material such as butadiene rubber or chloroprene rubber or a foam of the rubber material.

The insole 7 may be added with a function of sweat absorption, breathability, keeping dry, and removing foot odor in an existing manner.

Figure 6:
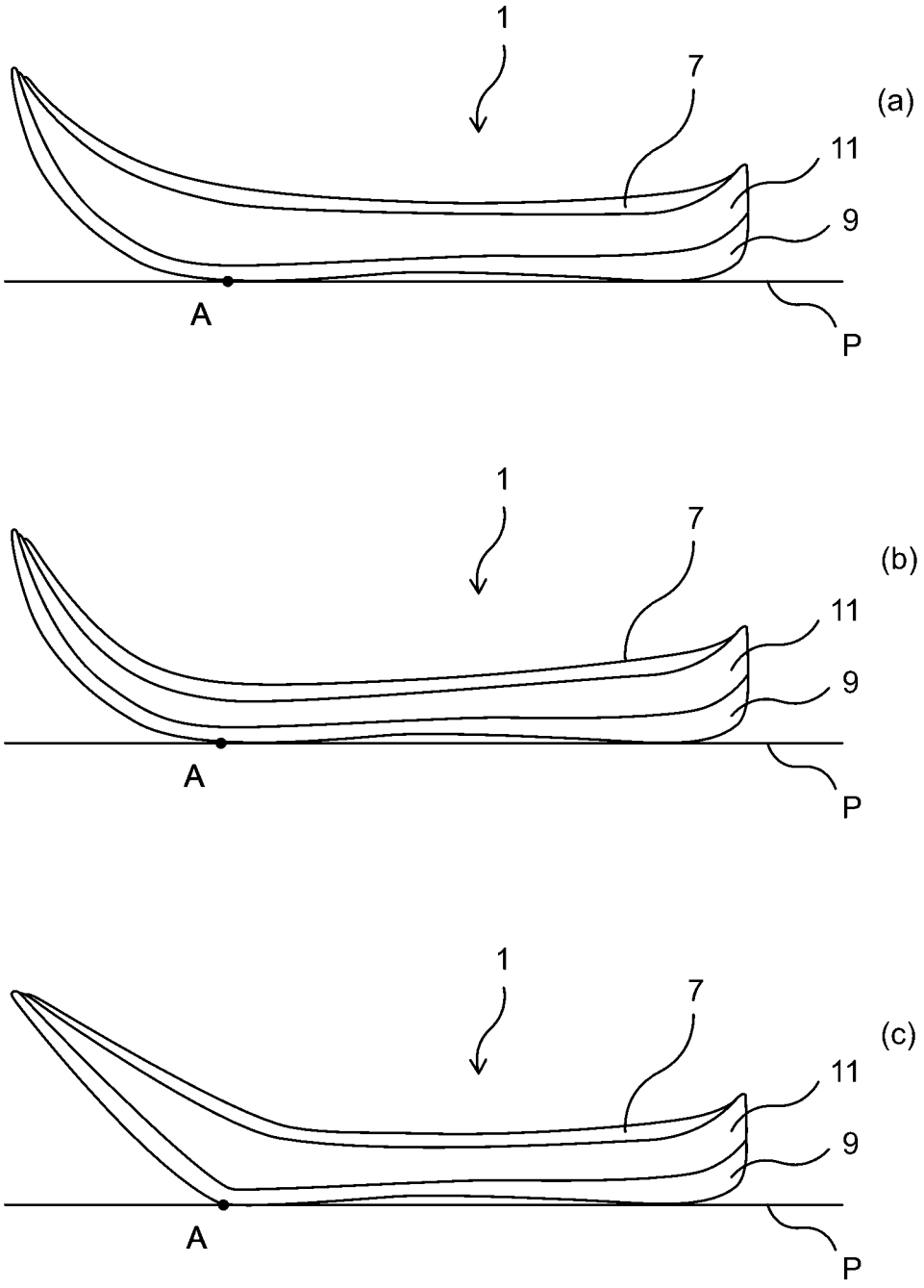
FIG. 6 is an explanatory view for illustrating one embodiment of a sole of the footwear of the present invention.

FIG. 6 is an explanatory view showing a modification of the outsole 9, the midsole 11, and the insole 7 in the II-II-line sectional view of FIG. 5(*a*).

FIG. 6(*a*) shows an embodiment in which the midsole 11 is thickened. The midsole 11 may be thickened in the forefoot portion. Furthermore, the outsole 9 may be thickened in the forefoot portion. In this aspect, it is preferable to satisfy the relationship of thickness of midsole 11>thickness of outsole 9>thickness of insole 7 in the forefoot portion.

FIG. 6(*b*) shows an embodiment in which the tip is thin. FIG. 6(*b*) shows that a midsole 11, an outsole 9, and an insole 7 become thinner on the tip side of the contact point A located closest to the toe side of the points where the sole bottom surface 5 is in contact with the plane P.

FIG. 6(*c*) shows an embodiment in which the bottom surface of the forefoot portion of the sole is flat.

A shock absorbing material may be arranged in the sole of the footwear of the present invention. The shock absorbing material is preferably placed above or below the midsole. In this case, the midsole may be dented, and it is preferable to hollow out a portion of the midsole and place the shock absorbing material therein.

The shock absorbing material is preferably arranged at least in the forefoot portion. For example, in FIG. 1, the shock absorbing material is preferably arranged in the region of the forefoot portion including the ball of the thumb P, the ball of the little toe Q, and the fingertips on which weight is applied. Shock absorbers may be placed in the forefoot portion and rearfoot portion.

Examples of shock absorbing materials include any material of thermoplastic synthetic resin foams such as ethylene-vinyl acetate copolymer (EVA) and polypropylene, thermosetting resin foams such as polyurethane (PU), foams of rubber materials such as butadiene rubber or chloroprene rubber, and the like.

A plate may be arranged in the sole of the footwear of the present invention. By arranging the plate, it is possible not only to maintain the shape of the tip of the footwear when not wearing it, but also to maintain the shape of the tip when walking or running.

By maintaining the shape of the warped tip of the footwear, it is possible to enhance the effect of suppressing deceleration at the time of landing and promoting acceleration at the time of stepping and kicking. In addition, by inserting the plate, it becomes easier to get a repulsion from the footwear when kicking, so that it is possible to walk and run efficiently.

The plate can be placed at a desired location of the sole. For example, it is preferably located between or within the outsole, midsole, or insole. If the outsole or midsole consists of multiple parts, it is preferable to include them.

The plate is preferably arranged at least in the forefoot portion. For example, the plate is preferably placed in the region of the forefoot portion including the ball of the thumb and the ball of the little toe, and the plate is more preferably placed in the region from the tip of the sole to the midfoot portion, and the plate is even more preferably placed in the entire region from the tip of the sole to the rear of the heel. In addition, it is desirable to place the plate on the part where the wearer's foot is in contact with the sole, and it may not be necessary to place the plate on the part corresponding to the arch where the weight is not applied. Further, holes or slits may be provided to the extent that the strength of the plate is not lowered, and the plate may be composed of one part or multiple parts.

The plate is preferably warped upward on the tip side (forefoot portion) to match the sole shape of the footwear. The plate may be moderately curved or arched to fit the wearer's foot. To maintain the structure warping upward on the tip side, the plate may be flat, in this case the plate is positioned transversely inside the sole.

The plate may be made of any material having moderate hardness and rigidity, such as fiber reinforced plastics such as carbon fiber composites, reinforced plastics such as metal fine particle composites, non-foamed plastics including hard polymers, and the like.

The thickness of the plate can be appropriately set depending on the material and its strength. The thickness of the plate is preferably 0.5 mm or more, more preferably 1 mm or more, and is preferably 2 cm or less, and more preferably 1.5 cm or less.

The plate is fixed with an adhesive or the like. A plurality of plates may be provided to enhance the strength thereof, and a gap may be provided to enhance mutual repulsion of the plates.

Figure 7:
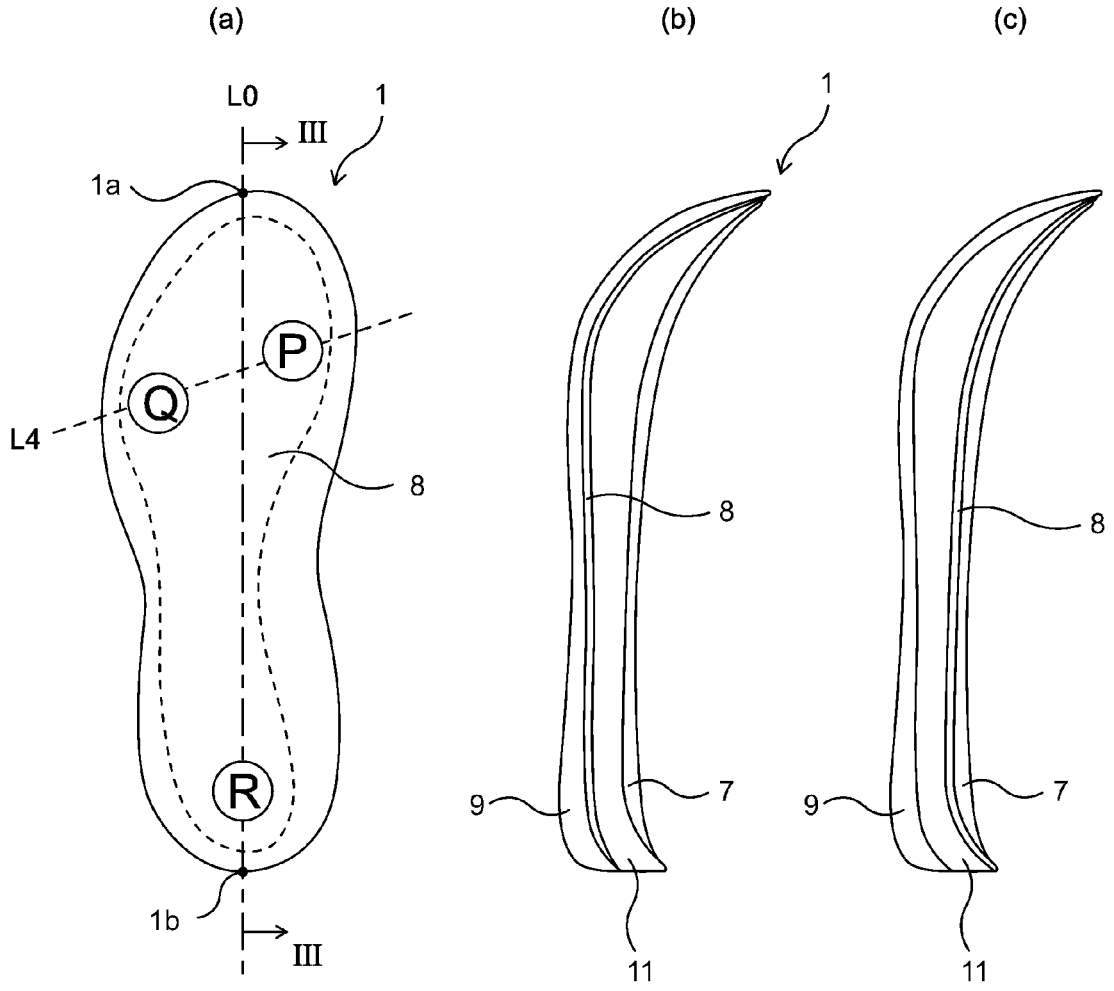
FIG. 7 is an explanatory view for illustrating one embodiment of a sole of the footwear of the present invention.

FIG. 7 is an explanatory view (cross-sectional view of the sole) illustrating an embodiment in which the plates are arranged. FIG. 7(*a*) is a plan view of the sole 1. As shown in FIG. 7(*a*), the plate 8 is preferably arranged so as to cover the fingertip, ball of the thumb P, ball of the little toe Q, and heel R. FIGS. 7(*b*) and 7(*c*) are sectional views taken along the line III-III in FIG. 7(*a*). In the embodiment shown in FIG. 7(*b*), a plate 8 extending from the front end to the rear end of the sole 1 is arranged between the outsole 9 and the midsole 11. In the embodiment shown in FIG. 7(*c*), a plate 8 extending from the front end to the rear end of the sole 1 is arranged between the midsole 11 and the insole 7.

Figure 8:
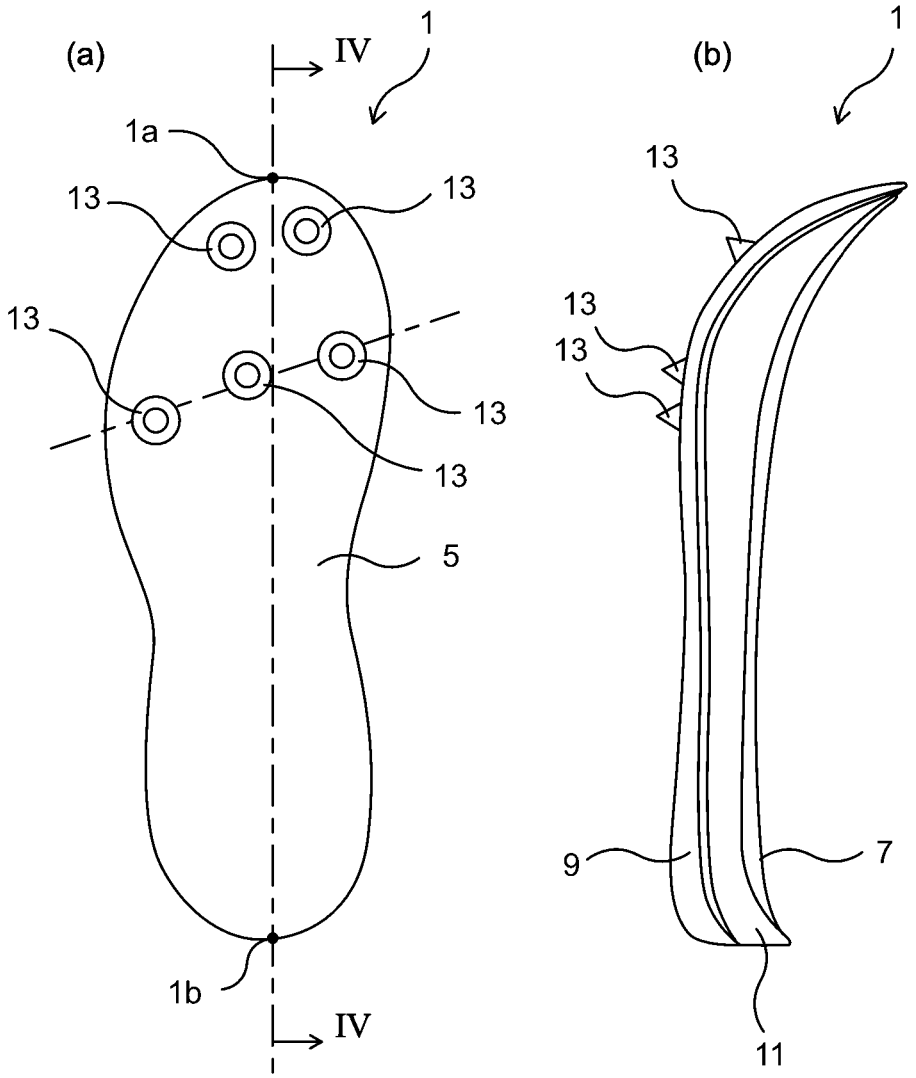
FIG. 8 is an explanatory view for illustrating one embodiment of a sole of the footwear of the present invention.

FIG. 8 is an explanatory view for illustrating another embodiment of the sole of the footwear of the present invention. FIG. 8(*a*) is a bottom view of the sole 1. FIG. 8(*b*) is a sectional view taken along line IV-IV of FIG. 8(*a*). A plurality of spikes 13 are provided on the tip part of the sole bottom surface 5. It is preferable that the spikes 13 are provided on the tip side from the vicinity of the line connecting the ball of the thumb and the little toe.

In the footwear of the present invention, an upper is preferably provided on the sole. The upper may have any construction and can be made by known techniques. It can be made durable, wear-resistant, and breathable.

The upper desirably has appropriate strength and stretchability so as to maintain the upward warp of the sole at the tip of the footwear, and is adhered to the sole by sewing, adhesive, or the like.

Figure 9:
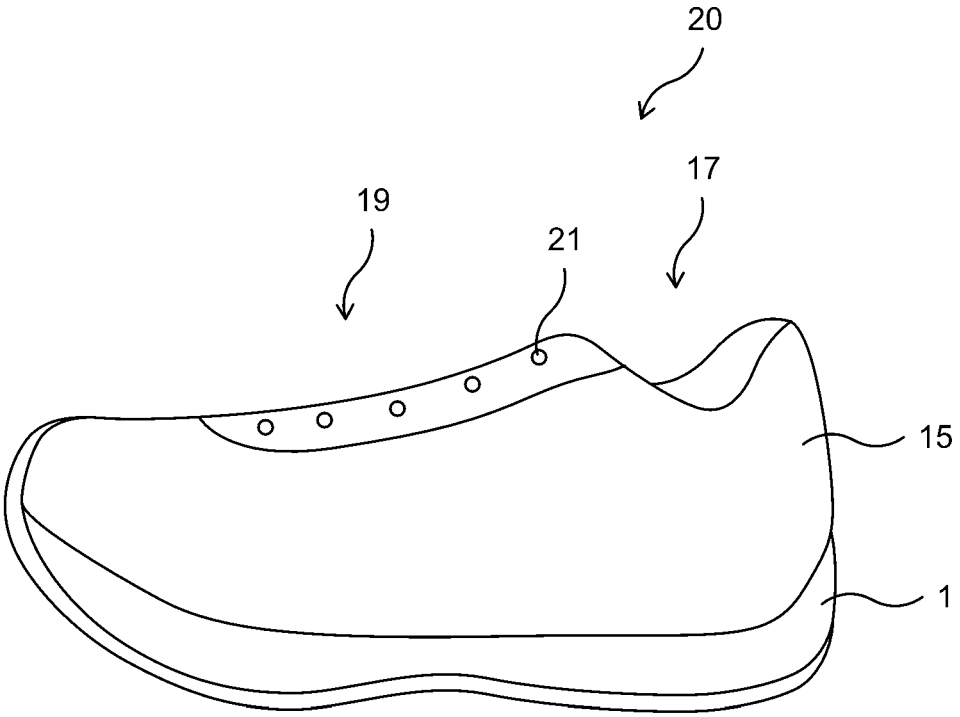
FIG. 9 is an explanatory view for illustrating one embodiment of the footwear of the present invention.

As shown in FIG. 9, the footwear 20 of the present invention has a sole and an upper 15 provided on the sole 1. The upper 15 is provided on the upper side of the sole 1 so as to cover the wearer's foot. The upper 15 is formed to cover the shoe from the forefoot portion to the rearfoot portion. It is preferable that the lower peripheral edge portion of the upper 15 and the upper peripheral edge portion of the sole 1 are fixed, for example, with an adhesive.

Suitable materials for the upper 15 include, for example, knitted fabrics, woven fabrics, non-woven fabrics, synthetic leathers, artificial leathers, and natural leathers. As the upper 15, a net-like mesh fabric obtained by warp-knitting threads made of a thermoplastic material such as polyester is suitable.

The upper portion of the upper 15 is provided with a first opening 17 for inserting the wearer's foot. Moreover, it is preferable that a second opening 19 extending in the front-rear direction is formed so as to communicate with the first opening 17. An eyelet decoration may be attached to the upper part of the upper by sewing or the like in the second opening 19. Eyelet holes 21 may be formed through the left and right edges of the eyelet decoration at intervals in the front-rear direction, and a shoelace (not shown) may be inserted through each eyelet hole 21. A tongue piece for opening or closing the second opening 19 is provided at the front edge of the second opening 19. By tying the laces, the foot is sufficiently secured to the shoe.

Although shoelaces and eyelet holes have been described as means for fixing the feet to the shoes, it is also preferable to change these to fixing means using hook-and-loop fasteners.

Figure 10:
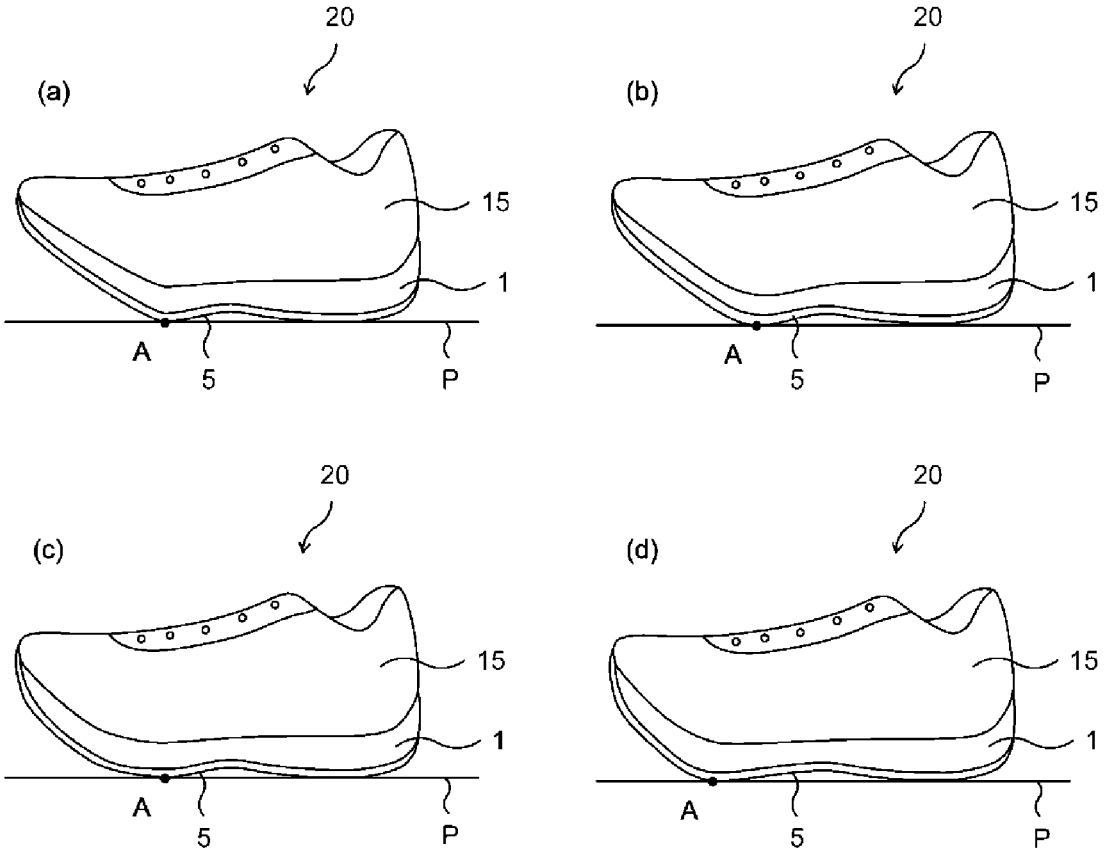
FIG. 10 is an explanatory view for illustrating a preferred embodiment of the footwear of the present invention.

FIG. 10 is an explanatory view for illustrating a modification of the footwear 20 of the present invention. In the footwear 20 of FIG. 10(*a*), the bottom surface 5 of the forefoot portion of the sole 1 is planar, and the sole 1 is bent at an obtuse angle near the ball of the thumb. The height of the upper surface of the sole in the middle foot portion and the height of the upper surface of the sole in the rear foot portion are substantially the same. The sole bottom surface of the rear foot portion has a contact surface with the plane P.

In the footwear 20 of FIG. 10(*b*), the bottom surface 5 of the forefoot portion of the sole 1 is planar, and the sole 1 is curved in the vicinity of the ball of the little toe. The height of the upper surface of the sole in the midfoot portion and the height of the upper surface of the sole in the rearfoot portion are substantially the same. The sole bottom surface of the rearfoot portion has a contact surface with the plane P.

The footwear 20 in FIG. 10(*c*) shows an embodiment in which the forefoot warp portion of the sole 1 is long. The bottom of the forefoot sole is curved downward, and the warp height is progressively higher from contact point A to the tip of the sole. The height of the upper surface of the sole in the midfoot portion and the height of the upper surface of the sole in the rearfoot portion are substantially the same. The sole bottom surface of the rearfoot portion has a contact surface with the plane P.

FIG. 10(*d*) shows an embodiment in which the forefoot warp portion of the sole 1 is short. The height of the upper surface of the sole in the midfoot portion and the height of the upper surface of the sole in the rearfoot portion are substantially the same. The sole bottom surface of the rearfoot portion has a contact surface with the plane P.

Figure 11:
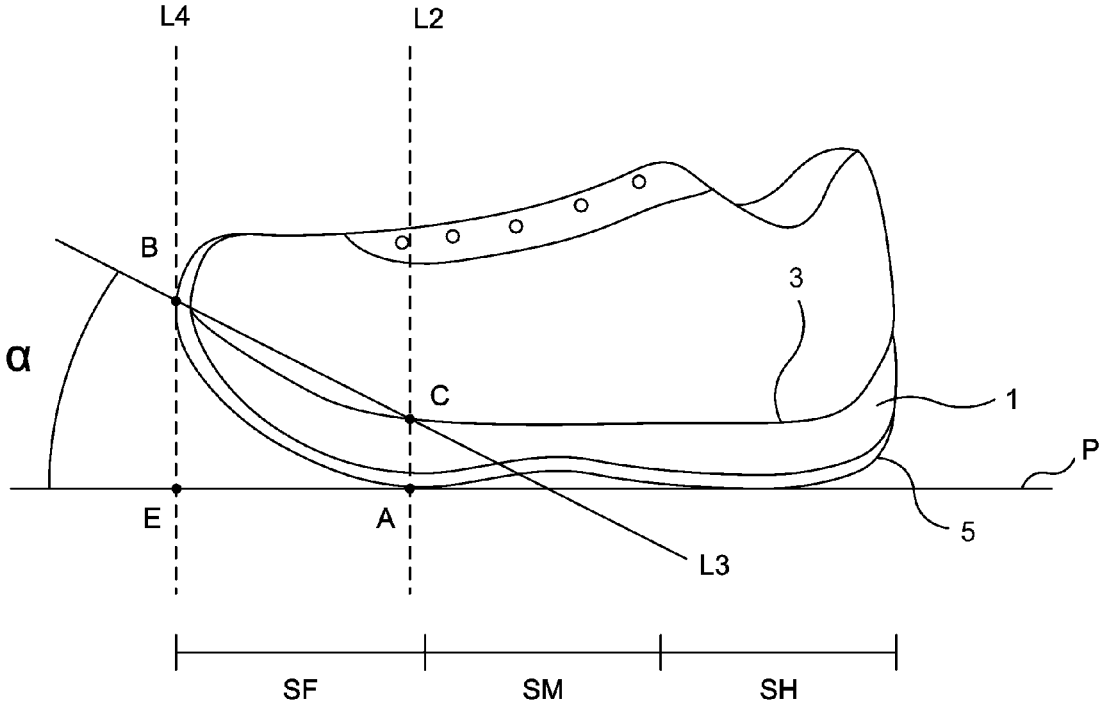
FIG. 11 is an explanatory view for illustrating one embodiment of the footwear of the present invention.

Examples of the footwear of the present invention will be described below. Table 1 shows an example of the structure of footwear. In Table 1, X, Y, and Z respectively represent the distance between points AE in FIG. 11 as X cm, the distance between points BE as Y cm, and the distance between points AC as Z cm.

TABLE 1

| Foot wear No. | X | Y | Z | Y-Z | α | β | β-α | β/α |
|---|---|---|---|---|---|---|---|---|
| 1 | 12 | 3 | 1 | 2 | 9.3 | 14.2 | 4.9 | 1.5 |
| 2 | 12 | 4 | 1 | 3 | 14.2 | 18.3 | 4.1 | 1.3 |
| 3 | 7 | 9 | 2 | 7 | 45.0 | 52.7 | 7.7 | 1.2 |
| 4 | 7 | 11 | 2 | 9 | 52.7 | 57.3 | 4.6 | 1.1 |
| 5 | 12 | 8 | 4 | 4 | 18.3 | 33.4 | 15.1 | 1.8 |
| 6 | 7 | 11 | 4 | 7 | 45.0 | 57.3 | 12.3 | 1.3 |

The footwear of the present invention is not particularly limited as long as it has the sole. Examples of footwear of the present invention include sports shoes such as walking shoes, tennis shoes, soccer shoes, football shoes, basketball shoes, running shoes, jogging shoes, and athletic shoes, and also include sandals, work boots, work shoes, boots, business shoes, leather shoes, safety shoes, nursing shoes, and mountaineering shoes. Among these, the footwear of the present invention preferably includes sports shoes, more preferably jogging shoes or running shoes.

Code explanation

1: sole, 15: upper, 3: upper surface of sole, 5: bottom surface of sole, 7: insole, 8: plate, 9: outer sole, 11: midsole, 13: spike, 17: first opening, 19: second opening, 20: footwear

The invention claimed is:

1. A footwear comprising a sole having an upper surface on a side configured to come in contact with a bottom of a foot and a bottom surface on a side that touches ground, wherein in a longitudinal cross-sectional view of the sole, an angle β is an angle between a straight line L1 and a plane a ground surface plane that the bottom surface of the sole is in contact with, and ranges from 35 degrees to 75 degrees, an angle α is an angle between a straight line L3 and the ground surface plane that the bottom surface of the sole is in contact with, and ranges from 25 degrees to 65 degrees, a contact point A is positioned closest to a toe side of points where the bottom surface of the sole is in contact with the ground surface plane, a point B is a point of the sole closest to the toe side, the straight line L1 passes through the contact point A and the point B, a line L2 passes through the contact point A and is perpendicular to the ground surface plane that the bottom surface of the sole is in contact with, and intersects with the upper surface of the sole at an intersection point C, the straight line L3 passes through the intersection point C and the point B, the angle $\alpha$ and the angle $\beta$ satisfies the relation $1 \leq (\beta/\alpha) \leq 1.5$, and a height of a toe spring is 7 cm or more and 14 cm or less.

2. The footwear according to claim 1, wherein the angle $\alpha$ ranges from 30 degrees to 65 degrees and the angle $\beta$ ranges from 40 degrees to 75 degrees.

3. The footwear according to claim 1, wherein the angle $\alpha$ and the angle $\beta$ satisfies the relation $1 \leq (\beta/\alpha) \leq 1.3$.

4. The footwear according to claim 1, wherein the bottom surface of the sole in a rearfoot portion has a contact surface that touches the ground in a state that a footwear wearer is wearing the footwear.

5. The footwear according to claim 1, wherein the sole has an insole having a surface configured to come in contact with the bottom of the foot, an outsole that touches the ground, and a midsole positioned between the insole and the outsole.

6. The footwear according to claim 1, wherein a shock absorbing material is arranged at least in a forefoot portion of the footwear.

7. The footwear according to claim 1, wherein a plate is arranged at least in a forefoot portion of the footwear.

8. The footwear according to claim 1, wherein the sole has spike pins on the bottom surface of the sole.

9. The footwear according to claim 1, wherein an upper is provided on the sole.

10. The footwear according claim 1, wherein the footwear includes a running shoe.

11. The footwear according to claim 1, wherein a height Hm of the upper surface of the sole in a midfoot portion and a height Hr of the upper surface of the sole in a rearfoot portion are substantially the same.

12. The footwear according to claim 11, wherein an absolute value ($|Hm-Hr|$) of a difference between the height Hm of the upper surface of the sole in the midfoot portion, and the height Hr of the upper surface of the sole in the rearfoot portion is 0 cm or more and 1.0 cm or less.

13. A footwear comprising a sole having an upper surface on a side configured to come in contact with a bottom of a foot and a bottom surface on a side that touches ground, wherein in a longitudinal cross-sectional view of the sole, an angle $\beta$ is an angle between a straight line L1 and a ground surface plane that the bottom surface of the sole is in contact with, and ranges from 35 degrees to 75 degrees, an angle $\alpha$ is an angle between a straight line L3 and the ground surface plane that the bottom surface of the sole is in contact with, and ranges from 25 degrees to 65 degrees, a contact point A is positioned closest to a toe side of points where the bottom surface of the sole is in contact with the ground surface plane, a point B is a point of the sole closest to the toe side, the straight line L1 passes through the contact point A and the point B, a line L2 passes through the contact point A and is perpendicular to the ground surface plane that the bottom surface of the sole is in contact with, and intersects with the upper surface of the sole at an intersection point C, the straight line L3 passes through the intersection point C and the point B, and a height Hm of the upper surface of the sole in a midfoot portion and a height Hr of the upper surface of the sole in a rearfoot portion are substantially the same.

14. The footwear according to claim 13, wherein the bottom surface of the sole in a rearfoot portion has a contact surface that touches the ground in a state that a footwear wearer is wearing the footwear.

15. The footwear according to claim 13, wherein the sole has an insole having a surface configured to come in contact with the bottom of the foot, an outsole that touches the ground, and a midsole positioned between the insole and the outsole.

16. The footwear according to claim 13, wherein a shock absorbing material is arranged at least in a forefoot portion of the footwear.

17. The footwear according to claim 13, wherein a plate is arranged at least in a forefoot portion of the footwear.

18. The footwear according to claim 13, wherein the sole has spike pins on the bottom surface of the sole.

19. The footwear according to claim 13, wherein an upper is provided on the sole.

20. The footwear according claim 13, wherein the footwear includes a running shoe.

* * * * *